US009448019B2

(12) United States Patent
Kokinis et al.

(10) Patent No.: US 9,448,019 B2
(45) Date of Patent: Sep. 20, 2016

(54) INTEGRATED SLIDE-CARRIER AND FIRING BLOCK ASSEMBLY

(71) Applicant: MACHINEGUNARMORY, LLC, Sandy, UT (US)

(72) Inventors: John Steven Kokinis, Sandy, UT (US); Paul Edward Gettings, Sandy, UT (US)

(73) Assignee: MACHINEGUNARMORY, LLC, Sandy, UT (US)

( * ) Notice: Subject to any disclaimer, the term of this patent is extended or adjusted under 35 U.S.C. 154(b) by 0 days.

(21) Appl. No.: 14/585,969

(22) Filed: Dec. 30, 2014

(65) Prior Publication Data

US 2015/0267984 A1 Sep. 24, 2015

Related U.S. Application Data

(60) Provisional application No. 61/926,029, filed on Jan. 10, 2014.

(51) Int. Cl.

| | |
|---|---|
| ***F41A 3/26*** | (2006.01) |
| ***F41A 5/26*** | (2006.01) |
| ***F41A 19/43*** | (2006.01) |
| *F41A 3/66* | (2006.01) |

(52) U.S. Cl.
CPC .. *F41A 3/26* (2013.01); *F41A 5/26* (2013.01); *F41A 19/43* (2013.01); *F41A 3/66* (2013.01)

(58) Field of Classification Search
CPC ..... F41A 3/26; F41A 5/18
See application file for complete search history.

(56) References Cited

U.S. PATENT DOCUMENTS

| | | | | |
|---|---|---|---|---|
| 1,452,465 A * | 4/1923 | Johnston | F41A 17/66 89/154 |
| 3,198,076 A * | 8/1965 | Stoner | F41A 3/26 42/75.02 |
| 5,614,691 A * | 3/1997 | Taylor | F41A 3/40 42/69.03 |
| 5,663,522 A * | 9/1997 | Kuehl | F41A 19/31 42/69.02 |
| 6,948,237 B2 * | 9/2005 | Ishii | G03B 17/30 24/469 |
| 7,562,614 B2 * | 7/2009 | Polston | F41A 19/33 42/69.03 |

FOREIGN PATENT DOCUMENTS

GB 191001610 A * 0/1910 ..... F41A 3/26

OTHER PUBLICATIONS

FN Herstal Minimi Calibre 7.62 x 51 mm NATO Catalog of Parts and Accessories, Mar. 2008, 58 pages.
*Small Arms Review*, Jan. 2010, pages and advertisements, 10 pages.
"Belt Fed Black Rifle," Jan. 2010, *Small Arms Review*, 11 pages.
J & T Distributing, Jan. 2010, *Small Arms Review*, 1 page.
Advertisement, Gun Envy MK 46 M249 Saw 5.56 Nato Belt Fed Semi, printed Dec. 23, 2013, 8 pages.

(Continued)

*Primary Examiner* — Troy Chambers
*Assistant Examiner* — Joshua Semick
(74) *Attorney, Agent, or Firm* — Workman Nydegger

(57) ABSTRACT

Implementations of the present invention relate to apparatuses, systems, and methods for firing a belt-fed closed-bolt firearm by delivering an impulse from an impulse source along a first axis to a firing pin on a second axis. The first axis and second axis are not coaxial, allowing the impulse source to be disposed away from and not in direct contact or alignment with the firing pin.

19 Claims, 12 Drawing Sheets

(56) References Cited

OTHER PUBLICATIONS

Shea, D. MGA's Semiautomatic MK46 Variant. Small Arms Review, 13(4), pp. 48-54, Chipotle Publishing, USA, published, on information and belief, at least as early as Jan. 2010.

Parts diagram, Rev. A: FN90E1031, published and available, on information and belief, at least as early as Sep. 9, 2003, 1 page.

* cited by examiner

INTEGRATED SLIDE-CARRIER AND FIRING BLOCK ASSEMBLY

CROSS-REFERENCE TO RELATED APPLICATIONS

This patent application claims priority to and the benefit of U.S. Provisional Patent Application No. 61/926,029, filed Jan. 10, 2014, titled "INTEGRATED SLIDE-CARRIER AND FIRING BLOCK ASSEMBLY," which is incorporated herein by reference in its entirety.

BACKGROUND OF THE DISCLOSURE

1. The Field of the Invention

Generally, this disclosure relates to firearms. More specifically, the present disclosure relates to methods, devices, and systems for operating a closed-bolt belt-fed firearm with greater reliability of operation, flexibility in platform, and ease of maintenance.

2. Background and Relevant Art

Belt-fed machine guns generally fall into two broad categories based on the way the gun fires ammunition: open-bolt or closed-bolt. In an open-bolt gun, the operating group, which includes the bolt, is held toward the rear of the receiver and away from chamber when not firing. The operating group is restrained, under tension from a spring, such that when the operating group is released, it moves forward forcefully. The forward movement shears a bullet off of a belt, delivers the bullet to the chamber, closes the chamber, and fires the bullet. In a closed-bolt gun, the operating group is held forward and against the barrel extension when not firing. The bolt is mated and locked to the barrel extension forming a closed chamber. The chamber may house a bullet waiting to be fired by an impulse from a hammer or other impulse source delivered to the bullet's primer by a firing pin.

An open-bolt gun is inherently a machine gun. Without input from an operator, an open-bolt gun will continuously fire, typically at a very high rate, as long as the weapon has ammunition or until the gun malfunctions. Each time the operating group moves forward in an open-bolt gun, the forward motion detonates the bullet's primer, firing the gun. The firing of a bullet generates a rapidly expanding gas within the barrel and some of the gas is diverted to a gas piston which forces the operating group rearward, opening the chamber and moving the next round into position, before a spring forces the operating group forward again, repeating the process until the ammunition is exhausted or an operator restrains the operating group in a rearward position.

A closed-bolt gun, conversely, may remain at rest with the operating group forward and a bullet chambered. The firing pin remains withdrawn from the bullet until an impulse source, such as a hammer or a striker, delivers an impulse to the firing pin to detonate the primer and charge in the bullet. At which time, the expanding gas in the barrel may be diverted to provide energy to cycle the operating group similarly to an open-bolt gun, except when the spring returns the operating group to a forward position, the bolt locks adjacent the barrel extension and the bullet in the chamber awaits the operator releasing the impulse source.

Prior to the Firearms Owners' Protection Act of 1986, open-bolt machine guns could be newly registered legally in the United States. The FABRIQUE NATIONALE D'HERSTAL ("FN") MINIMI open-bolt machine gun (and the affiliated United States variant, the M249 light machine gun platform) was among the most common open-bolt machine guns available at the time, and remains one of the most common open-bolt machine guns in the world. The FN MINIMI was originally developed in 1974 and has continued in operation with militaries in 45 countries. There are a great deal of parts, accessories, and assemblies available for the platform on the market, and the transfer of open-bolt machine guns legally registered before May 19, 1986 is legal through proper channels and with proper documentation. However, the production of new open-bolt machine guns, such as the M249 platform, for civilian sale in the United States is now illegal. Due to the reputation and restricted availability of the M249 platform, there remains a demand for M249-type firearms among civilians, as well as a robust market around the original guns.

However, an open-bolt belt-fed machine gun, such as the M249 platform has a number of disadvantages for use in military or law enforcement conflicts despite the high rate of fire of the weapon. Typically, the high rate of fire of the M249 platform (approximately 800 rounds per minute) results in challenges for the operator to control the recoil and therefore accuracy of the weapon. Furthermore, in many cases, the advantages of outputting up to 800 rounds per minute may be outweighed by the consumption of ammunition. For example, 200 rounds of 5.56 mm×45 mm NATO ammunition, not including the belt links, weighs almost 6 pounds and an M249-platform machine gun can fire all 6 pounds of ammunition in 15 seconds. The M249 platform also supports a 7.62 mm×51 mm NATO variant that weighs twice as much per round. Therefore, mobility of the gun and operator is directly tied to ammunition consumption.

Closed-bolt rifles are legal to manufacture, sell, and own (when properly registered in territories requiring registration) and are not subject to many of the 1986 registration limitations. Closed-bolt rifles capable of full-automatic firing are still regulated. Conversion of a semiautomatic closed-bolt gun to a full-automatic closed-bolt gun is possible with a registered sear that is properly registered with appropriate authorities. However, closed-bolt rifles are capable of semi-automatic fire, burst fire (a fixed number of rounds greater than one), or full-automatic fire with each pull of the trigger. Furthermore, the different firing modes of closed-bolt rifles may be freely selected by a fire mode selector switch commonly mounted on the grip of the rifle allowing a closed-bolt rifle to be freely altered between semi-automatic, burst, and full-automatic firing modes quickly and easily depending on the needs of the operator.

The closed-bolt, hammer- or striker-operated platform, therefore, has operational flexibility that an open-bolt platform cannot offer. Additionally, there are many manufacturers that offer a wide variety of hammer- or striker-operated trigger packages for sale. For example, HECKLER & KOCH manufactures hammer-operated trigger packages that offer selectable fire modes between "safe;" semi-automatic fire; burst fire of two, three, or more rounds at a time; or full-automatic and any combination thereof.

However, an open-bolt gun is not hammer- or striker-operated, and therefore, there is no mechanism by which a hammer or striker may strike a firing pin. Previous attempts to simply drill a bore through the slide and extend the firing pin through the operating group necessitated an additional extension of a hammer beyond the available sizes as is described in "MGA's Semiautomatic MK46 Variant" by Dan Shea, *The Small Arms Review*, Vol. 13 No. 4, January 2010, pp. 48-54, which is incorporated herein in its entirety by reference. The target operational lifetime for belt-fed firearms is more than 100,000 rounds. The extra length of the bore, firing pin, and hammer all create additional strain on internal components resulting in increased likelihood of firearm failure.

Therefore, it would be desirable to enable the use of a hammer- or striker-operated trigger package with selectable fire modes with an M249-type platform by conversion of the open-bolt M249 or similar platform to a closed-bolt platform and providing a mechanism by which a commercially available standard hammer or striker may impart force to a firing pin.

BRIEF SUMMARY OF THE DISCLOSURE

Implementations of the present disclosure solve one or more of the foregoing or other problems in the art with apparatuses, systems, and methods for detonating a round in a closed-bolt self-loading firearm using a non-coaxial impulse source. The present disclosure provides an integrated slide-carrier and firing block, which function to couple the impulse source, such as a hammer or striker, to the firing pin where the motion of the impulse source and the firing pin are not coaxial.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
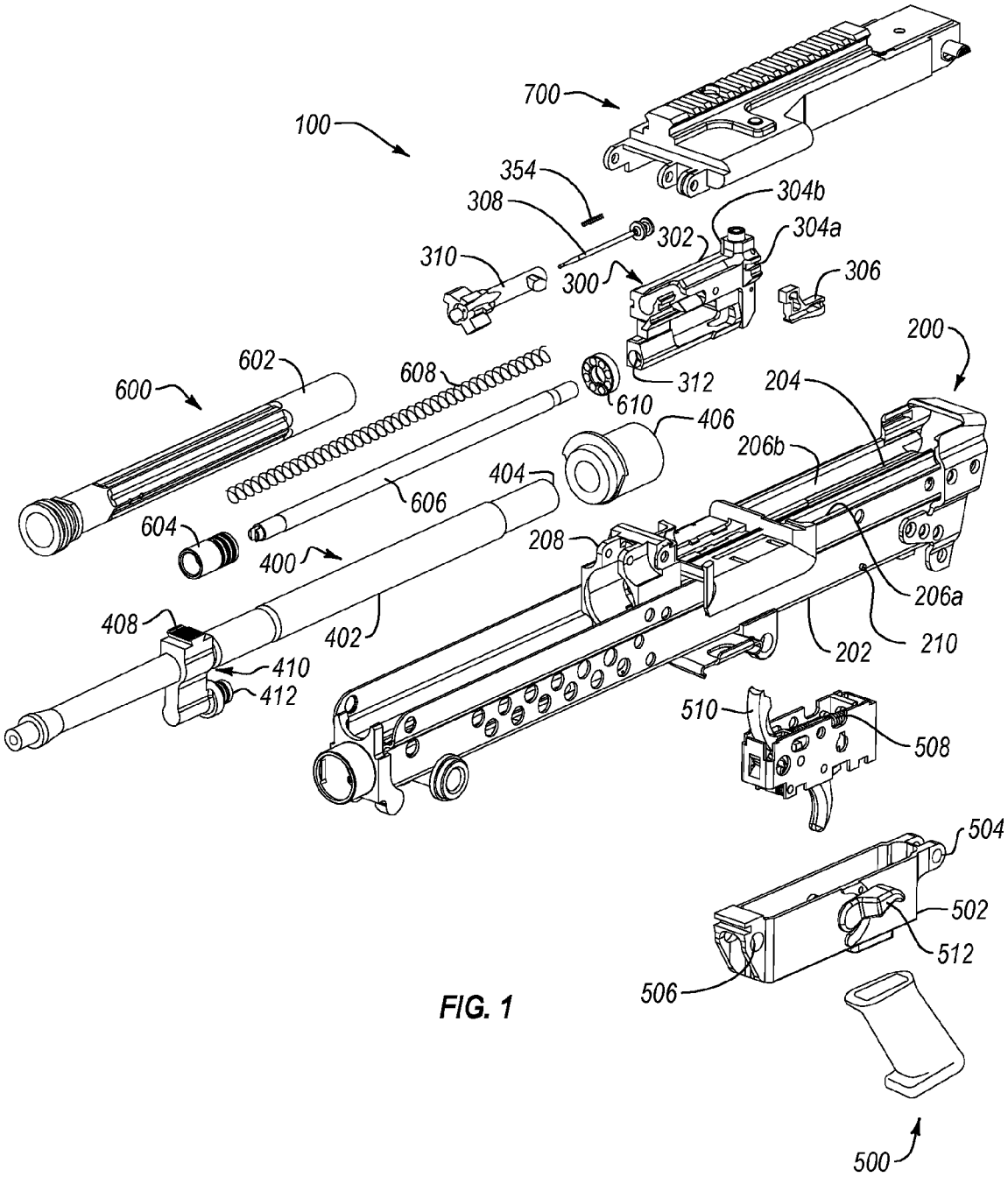
FIG. 1 depicts an isometric exploded view of a firearm according to the present disclosure.

One or more implementations of the present invention relate to methods, devices, and systems for firing a closed-bolt self-loading firearm. The methods, devices, and systems involve the transmission of force from an impulse source through a non-linear path to a propellant configured to accelerate a projectile. The methods, devices, and systems may also allow the operation of other functionality of the firearm, such as feeding ammunition, ejecting ammunition, resetting the impulse source or opening and closing a chamber.

The FABRIQUE NATIONALE D'HERSTAL ("FN") M249 platform is one of the most common light machine gun platforms in the world, including many variants and having countless available accessories. However, the M249 platform is an open-bolt, slam fire weapon. The open-bolt, slam fire M249 platform has only two modes of operation: 800 round-per-minute ("RPM") fully automatic firing and not firing. When firing at 800 RPM, the firearm is difficult to control and expends ammunition quickly. An option to operate the M249 platform as a closed-bolt, hammer fired weapon is desirable. However, the design of a closed-bolt, hammer fired gun on the M249 platform requires modification of the internal operating group.

The present disclosure relates to the modification and replacement of the internal operating group to produce a closed-bolt, hammer fired operation in an M249-type platform. The carrier, slide, recoil spring, gas tube, trunnion, gas block, grip, trigger housing, and operating rod must all be redesigned; and a sear and trigger of the open-bolt system must be replaced with trigger package containing a hammer or other impulse source. A closed-bolt operating group may include an integrated slide-carrier that enables the use of a substantially standard bolt, firing pin, and trigger package, while translating the force applied from a first axis to a second axis in order to allow proper operation of the firearm in a semi-automatic, burst-fire, or fully-automatic firing mode. The first and second axes may each be longitudinal axis and, therefore, parallel or non-parallel axes, such as perpendicular or at an acute angle to one another. Furthermore, the directions of the forces, even when the axes are parallel, may not be the same.

The integrated slide-carrier may incorporate the functionality of a slide and carrier while allowing additional functionality by removing the division and, hence, connection therebetween. The slide-carrier may allow for more reliable operation of the gun with less moving parts to replace or maintain and for less chance of failure in the field. The slide-carrier may also allow the transmission of a firing force from an impulse source through the slide-carrier to a firing pin, which may then transmit the force to a propellant in the ammunition. The slide-carrier may also enable the translation of the firing force in a non-linear path or along more than one axis.

The elimination of the connection between the slide and carrier may enable the integrated slide-carrier to transmit force from expanding gas rod to the slide more directly. The monolithic construction of the integrated slide-carrier may thereby reduce torque applied on receiver rails to which the slide-carrier is slidably mounted. Reduced torque on the slide may reduce wear on the receiver rails, providing a further increase in reliability and reduction in maintenance of the firearm.

Figure 2:
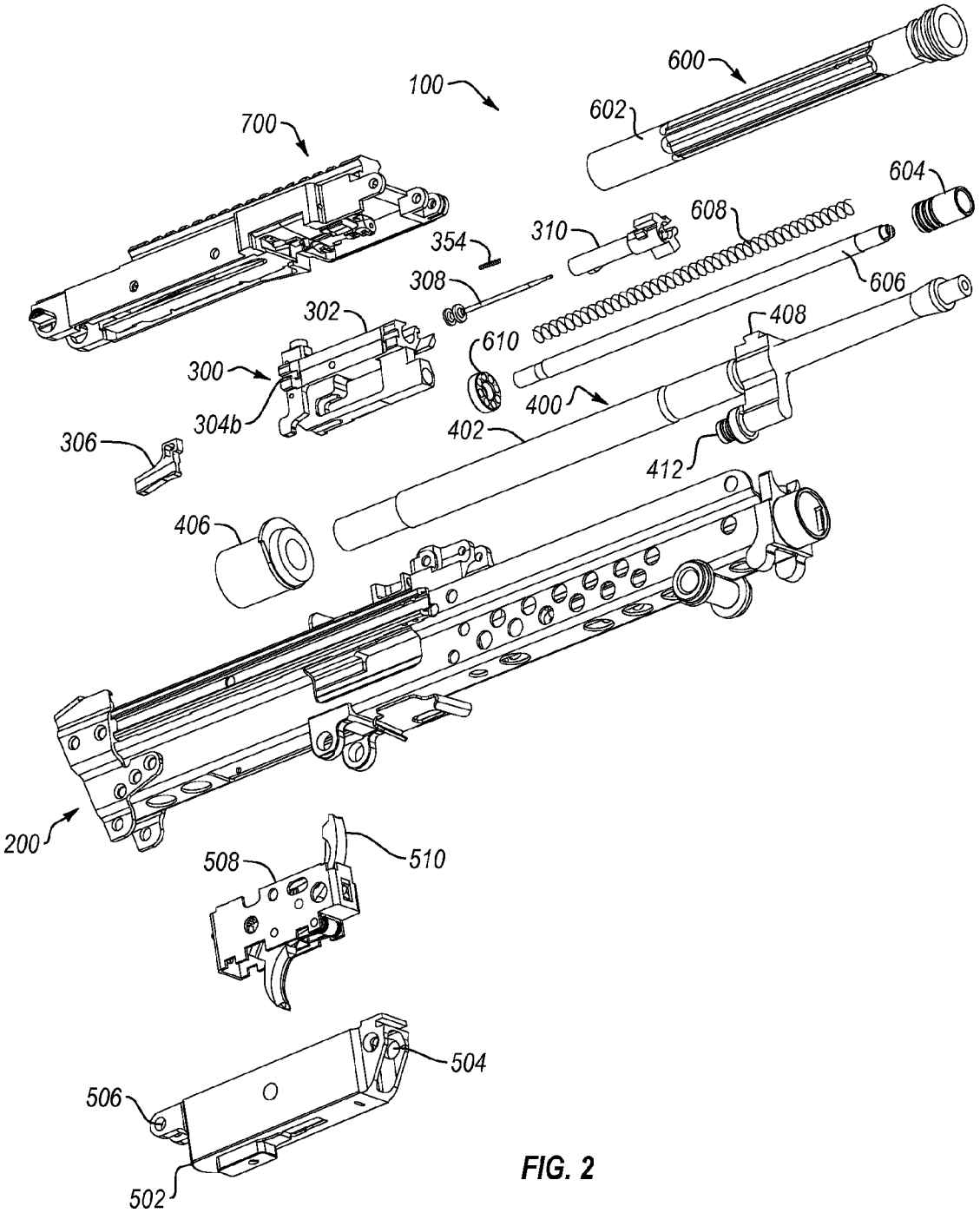
FIG. 2 depicts a lower isometric exploded view of the firearm of FIG. 1.

FIG. 1 depicts an isometric exploded view of the main operational components of an embodiment of a firearm 100 including an integrated slide-carrier assembly. FIG. 2 depicts a lower isometric exploded view of the main components of the firearm 100. The firearm 100 includes a receiver 200, which may carry upon it various information engraved or otherwise affixed thereto. The information on the receiver 200 may commonly include model designation and identification information unique to that receiver to identify the firearm 100 for registration and ownership purposes. The receiver 200 may also enable the connection and assembly of many of the operational components on or in the receiver 200. For example, the receiver 200 includes a receiver body 202 that defines an interior channel 204 with left and right receiver rails 206*a*, 206*b* affixed thereto. The left receiver rail 206*a* and right receiver rail 206*b* may be symmetrical with respect to one another, or they may be asymmetrical. For example, the left receiver rail 206*a* and the right receiver rail 206*b* may have differing thicknesses or they may be positioned differently in the interior channel 204. The left receiver rail 206*a* may be thicker or thinner than the right receiver rail 206*b*. Additionally or alternatively, the left receiver rail 206*a* may be positioned higher or lower than the right receiver rail 206*b*. Furthermore, the left receiver rail 206*a* may be longer or shorter longitudinally within the interior channel 204 than the right receiver rail 206*b*. The receiver 200 further comprises a selector stop 210. The selector stop 210 may be affixed to an exterior surface of the receiver or may be a raised portion of the receiver itself. The selector stop 210 inhibits a fire mode selector switch 512 such as that found on commercially available hammer-operated trigger packages from reaching a "disassemble" position, as will be explain in relation to FIGS. 14A-C.

The operating group 300 is slidably connected to the receiver 200 by the left and right receiver rails 206*a*, 206*b*. The operating group 300 includes the integrated slide-carrier 302 (described further in FIGS. 3-8) having an elongate upper section in which there are left and right longitudinal recessions 304*a*, 304*b*. The left and right longitudinal recessions 304*a*, 304*b* receive the left and right receiver rails 206*a*, 206*b*, respectively, to allow the longitudinal movement of the operating group 300 within the interior channel 204 of the receiver 200. The operating group 300 further includes a firing block 306 that is disposed at least partially inside the integrated slide-carrier 302. Alternatively, the firing block 306 may be disposed entirely externally to the intergrated slide-carrier. (The firing block 306 will also be described more fully in relation to FIGS. 5-9.) The firing block 306 transmits a force to the firing pin assembly 308, which is at least partially disposed within a bolt 310. The bolt 310 includes notches, grooves, channels, or threads for selectively connecting to another, complementary connector.

Still referring to FIG. 1, the receiver 200 also includes a central trunnion 208 into which the barrel assembly 400 connects. The barrel assembly 400 comprises a barrel body 402 that includes a bore 404 therethrough. The bore 404 provides communication between the barrel body 402 and a barrel extension 406. Together, the barrel extension 406 and the bore 404 provide a path through which a bullet (not shown) may exit the firearm 100.

The barrel assembly 400 also includes a gas block 408 disposed on the barrel body 402 forward of the barrel extension 406. The gas block 408 covers a gas port 410 and provides fluid communication with a gas block outlet 412. After firing a bullet, rapidly expanding gas may travel the length of the barrel body 402 through the bore 404. As the gas passes the gas port 410, the gas block 408 may channel some of the gas laterally away from the bore 404 and toward the gas block outlet 412. The diverted gas may be expelled through the gas block outlet 412 and provide the motive force to cycle the firearm 100 and prepare for a subsequent firing.

The barrel assembly 400 connects to the receiver 200 by inserting the barrel extension 406 into the central trunnion 208. The barrel extension 406 may connect to the trunnion 208 via threads, a twist lock, a friction fit, a weld, an adhesive or other secure attachment. The connection between the barrel 406 and the trunnion 208 may be selectively attachable to facilitate maintenance and repair of the firearm 100. The barrel extension 406 provides complementary notches, grooves, channels, or threads into which the bolt 310 may be received and selectively secured thereto. The connection of the bolt 310 to the barrel extension 406 provides a selectively securable connection between the barrel assembly 400 and the internal operating group 300. The connection of the operating group 300 and the barrel assembly 400 provides a chamber in which a bullet may be held and fired (visible in FIGS. 12A-B).

Still referring to FIG. 1, the firearm 100 further includes a control assembly 500 disposed on the underside of the firearm 100 and selectively connected to the receiver 200. The control assembly includes a housing 502 with front mounting points 506 and rear mounting points 504. The front mounting points 506 may be a notch that is configured to be received into a recession on the receiver body 202, eyelets for a cross-bar, a snap fit, or other similar selectively securable connection. Similarly, the rear mounting points 504 may be a notch configured to be received into a recession on the receiver body 202, eyelets for a cross-bar, a snap fit, or other similar selectively securable connection. A trigger package 508 is disposed within the housing 502 of the control assembly 500. The trigger package includes an impulse source such as a hammer 510, as depicted in FIG. 1, or a striker or other similar linear actuator. The trigger package 508 may be a commercially available trigger package and may include safe, semi-automatic, 2-round burst, 3-round burst, fully automatic, or other fire operation modes selectable with a fire mode selector switch 512. The trigger package 508, more specifically, may comprise a HECKLER AND KOCH trigger package. The trigger package 508 may operate the firearm 100 without modification to the trigger mechanism. Other modifications not affecting the trigger mechanism may include, for example, removal of the ejector.

Continuing to refer to FIG. 1, the firearm 100 further comprises a gas piston assembly 600 that provides a fluid and mechanical linkage between the barrel assembly 400 and the operating group 300. The gas piston assembly 600 connects the barrel assembly 400 to the operating group 300 by a gas piston-and-cylinder linkage. The gas tube 602 is disposed around, or otherwise forms a fluid seal with, the gas block outlet 412. The gas block outlet 412 may provide a source of high pressure gas, which may impinge upon a surface of a gas piston 604. The gas piston 604 is connected to a rigid operating rod 606, which is, in turn, connected to the operating group 300. The operating rod 606 is connected to the operating rod connection 312 on the integrated slide-carrier 302 of the operating group 300. The connection between the operating rod 606 and the operating rod connection 312, and the connection between the gas piston 604 and the operating rod 606, may be any connection of sufficient strength to communicate the compressive and tensile forces produced during operation of the firearm 100. For example, the connection may be threads, a twist lock, a friction fit, a weld, an adhesive or other secure attachment. Preferably the connection may be a selective connection facilitating maintenance and repair of the firearm 100, and more preferably, the connection may be adjustable to allow precise tuning of the operation of the firearm 100. For example, the connection may be a threaded connection providing a selective and adjustable connection. A threaded connection may further comprise a lateral set screw to retain the connection at the selected relative position.

The gas piston assembly 600 may allow the high pressure gas, the gas contained within the barrel bore 404 and directed through the gas block 408 and gas port 410 to the gas block outlet 412, to provide the energy for a motive force to cycle the operating group 300. The motive force may be a reciprocal linear force resulting from the pressure of the impinging gas from the gas block outlet 412 in the rearward direction, and an opposite linear force from a recoil spring 608 disposed circumferentially around the operating rod and compressed between a surface of the gas piston 604 and a bushing 610 disposed adjacent the trunnion 208. The bushing 610 is an annular bushing configured to allow the operating rod 606 to slide through a central opening in the bushing 610 while the recoil spring 608 is retained by an annular surface of the bushing 610. Hence, when the high pressure gas impinges upon the gas piston 604, the gas piston 604 travels rearward along the length of the gas tube 602, and compresses the recoil spring 608 against the bushing 610 adjacent the trunnion 208. The seal between the gas piston 604 and the gas tube 602 allows for the passage of a portion of the high pressure gas, allowing dissipation of the pressure in the gas tube 602. The gas that escapes beyond the gas piston 604 may then pass through channels in the bushing 610 and escape the firearm 100, dissipating the gas in the gas tube 602.

The recoil spring 608 may then provide a restoring force in opposition to the rearward movement of the gas piston 604. The restoring force causes the gas piston 604 to travel forward in the gas tube 602 until the gas piston 604 returns to a position adjacent the gas block outlet 412. Thus, each firing of the firearm 100 may result in a reciprocal motion of the gas piston 604 within the gas tube 602. The reciprocal motion of the gas piston 604 within the gas tube 602 with each firing of the firearm 100 provides the motive force to reciprocally move the operating group 300 within the receiver 200.

The reciprocal motion of the operating group 300 may provide the input force for nearly all other operations of the firearm 100, as will be discussed in relation to FIGS. 10-15. For example, the motion of the operating group 300 after the firing of a first round and the introduction of high-pressure gas through the gas port 610 and into the gas tube 602, unlocks the bolt 310 from the barrel extension 406, extracts a shell casing, ejects the shell casing, resets the trigger package 508, removes a second round from an ammunition source, inserts the second round into the barrel extension 406, and then locks the bolt 310 in the barrel extension 406. Many of these functions are provided by the integrated slide-carrier 302 of the operating group 300, depicted in detail in FIGS. 3-8.

As can also be seen in FIG. 1, the firearm 100 comprises a top cover 700, as is known in the art, configured to feed in a belt of ammunition. The top cover 700 feeds ammunition with a lever-activated feed driven by the bearing 328 of the operating group 300. The bearing 328 may follow a track in the top cover 700 providing an incremental, lateral feed of ammunition, as is visible in FIG. 2. The top cover 700 is specific to the type and size of ammunition being fired.

Figure 3:
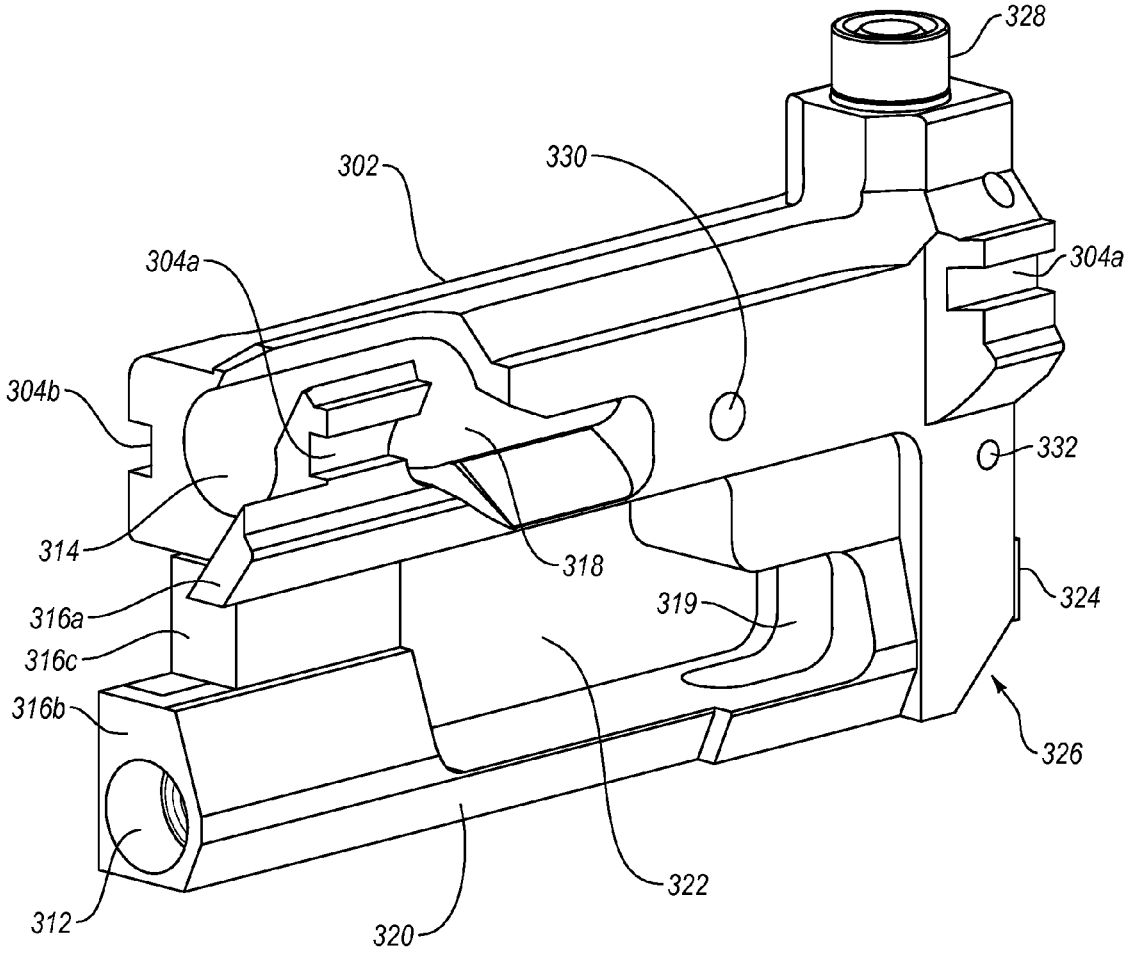
FIG. 3 depicts an isometric view of an integrated slide-carrier according to the present disclosure.

Referring now to FIG. 3, the integrated slide-carrier 302 comprises the left and right longitudinal recessions 304*a*, 304*b*, which receive the left and right receiver rails 206*a*, 206*b* respectively to facilitate the longitudinal, reciprocal movement of the operating group 300 within the interior channel 204 of the receiver 200. The integrated slide-carrier 302 also comprises a slide bore 314, into which a firing pin 308 and bolt 310 (not depicted) may be inserted. The bore extends from near a forward end of the integrated slide-carrier 302 substantially through the length of the integrated slide-carrier 302, but not through the entire integrated slide-carrier 302. The bore is recessed from a front end of the integrated slide-carrier 302 to allow the bolt 310 (not depicted) to properly lock into the barrel extension 406.

Figure 4:
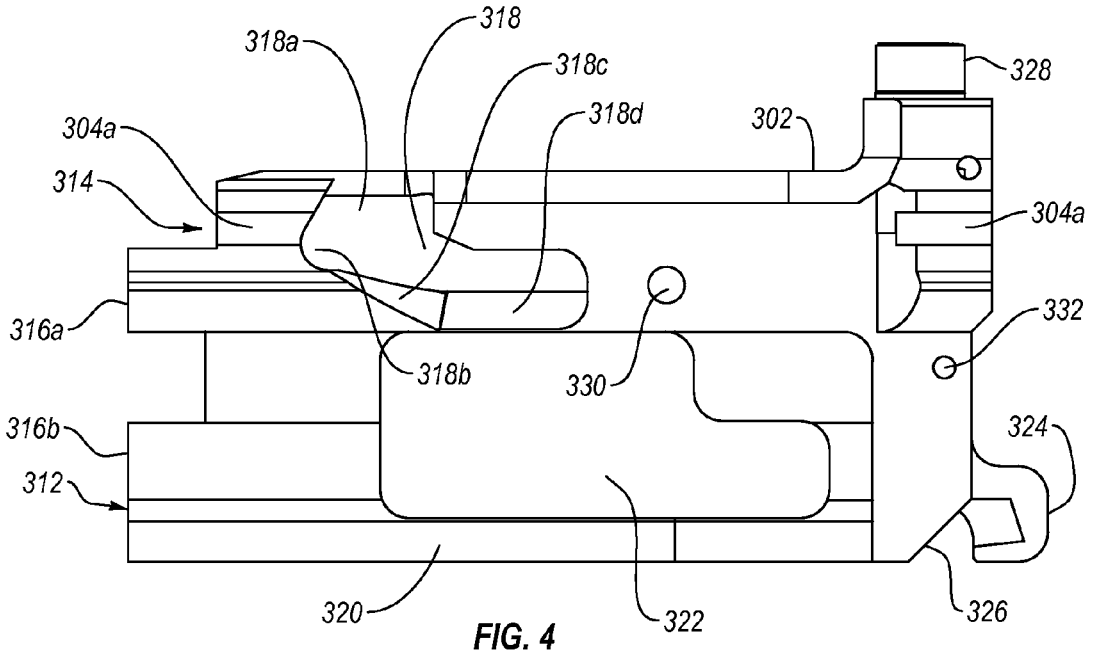
FIG. 4 depicts a left side view of the integrated slide-carrier of FIG. 3.

Referring now to FIG. 4, the front end of the integrated slide-carrier 302 comprises an upper front surface 316*a* and a lower front surface 316*b*, which are co-planar. The co-planar upper front surface 316*a* and lower front surface 316*b* extend on either side of the barrel extension 406 when the firearm 100 is in battery. The integrated slide-carrier 302 is held against the barrel extension 406 by the recoil spring 608 and the operating rod 606 connected to the operating rod connector 312. A contact surface 316*c* may distribute the compressive force between the integrated slide-carrier 302 and the barrel extension 406 to reduce strain and wear on the integrated slide carrier 302.

Still referring to FIG. 4, the integrated slide-carrier 302 further comprises a rotation channel 318 associated with the slide bore 314. The rotation channel 318 guides the rotation of the bolt 310 to lock and unlock the bolt 310 from the complementary channels in the barrel extension 406. The rotation channel 318 comprises an upper portion 318*a*, a catch 318*b*, a rotational portion 318*c*, and a longitudinal portion 318*d*. The upper portion 318*a* has a rearward slanted front face and a vertical rear face, while the rotational portion 318*c* has a forward slanted front face and forward slanted rear face, while the catch 318*b* forms the junction of the upper portion 318*a* and the rotational portion 318*c*. The upper portion 318*a* allows manual removal or installation of a bolt 310 by rotating the bolt 310 through the upper portion 318*a* and drawing the bolt 310 out through the slide bore 314. During normal operation, however, the catch 318*b* prevents the unintended removal of the bolt 310.

Still referring to FIG. 4, the integrate slide-carrier 302 comprises a lower support 320. The lower support 320 provides structural support to the integrated slide-carrier 302 and thereby reduces strain and wear on the integrated slide-carrier 302 to prevent failure of the operating group 300. The lower support 320 extends substantially the length of the integrated slide-carrier 302 and defines a central space 322. The lower support 320 connects to the remainder of the integrated slide-carrier 302 by one or more points. The central space 322 is devoid of material or may comprise material of different mass than the integrated slide-carrier 302, in order to tune the mass of the operating group 300. The mass of the operating group 300 may need to change to ensure proper operation of the firearm 100 depending on operating conditions, ammunition type, the spring constant of the recoil spring 608, the size of the gas port 410, or other factors.

The integrated slide-carrier 302 additionally comprises a sear release arm 324, enabling the firearm 100 to be operated in a fully automatic firing mode. The sear release arm 324 is configured to release a sear in a hammer-operated fully automatic firing mechanism, such as some HECKLER AND KOCH trigger packages. The integrated slide-carrier 302 also comprises a bevel 326 configured to engage a hammer 510 or other impulse source of a trigger package 508 and reset the hammer 510 or other impulse source as the operating group 300 cycles rearward after firing. The integrated slide-carrier 302 may also comprise a channel configured to hold the bearing 328 which may engage with a top cover 700 (not depicted) to feed ammunition automatically into the firearm 100.

Figure 5:
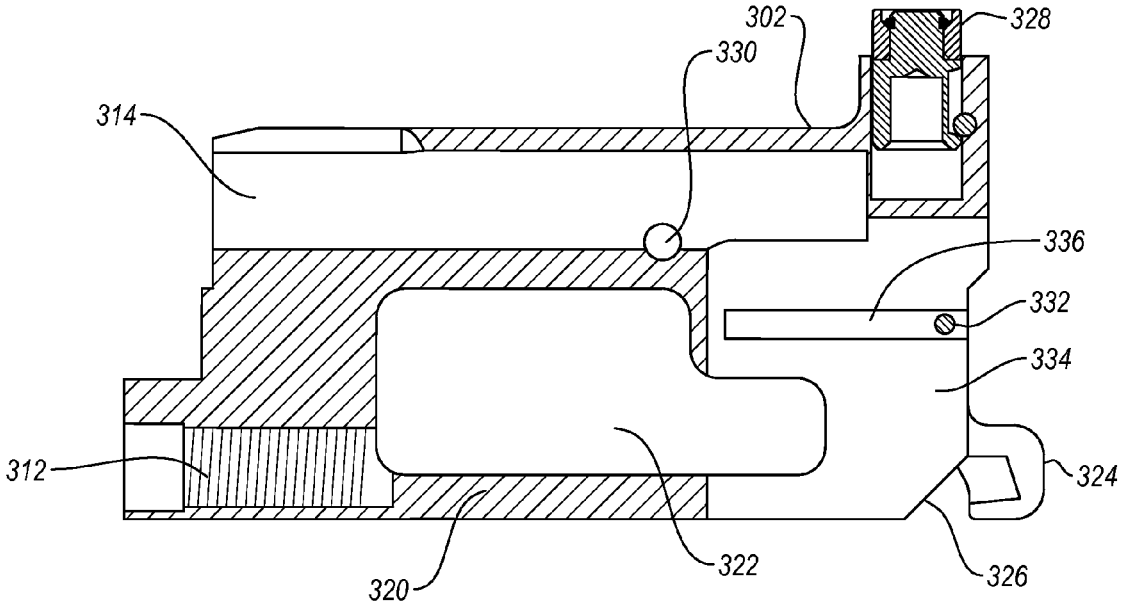
FIG. 5 depicts a left side cross-sectional view of the integrated slide-carrier of FIG. 3.

As shown in FIG. 5, the slide bore 314 extends through some, but not all of the integrated slide-carrier 302. Alternatively, the slide bore 314 may extend through substantially the entire length of the integrated slide-carrier 302. The slide bore 314 includes a hole for a bore cross-pin 330 that intersects the slide bore 314 and may retain the firing pin 308 within the slide bore 314. The bore cross-pin 330 retains the firing pin 308 within a desired range of motion, allowing for the selective extension of the firing pin 308 through and out of the bolt 310 to set off the ammunition when in battery.

Figure 6:
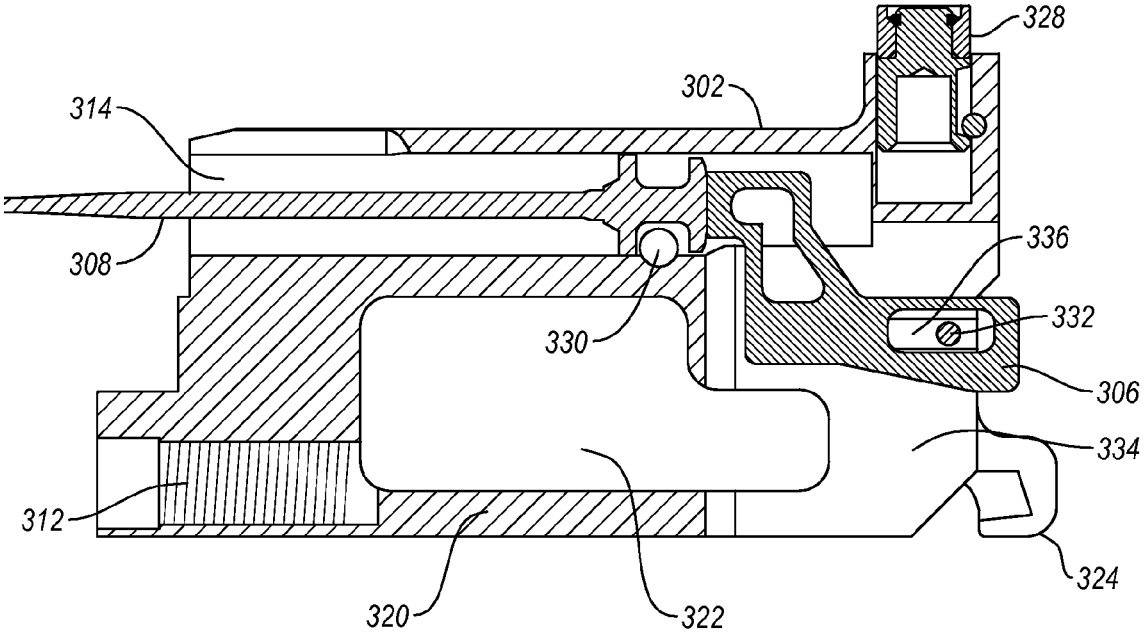
FIG. 6 depicts a left side cross-sectional view of the integrated slide-carrier of FIG. 3, further including a firing pin and firing block.
Figure 7:
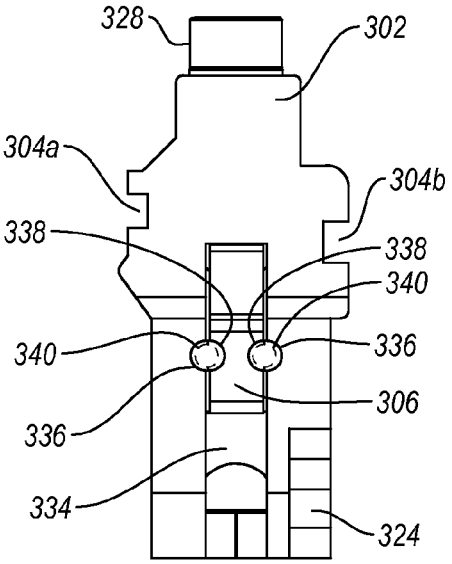
FIG. 7 depicts a rear end view of the integrated slide-carrier and firing block of FIG. 6.
Figure 8:
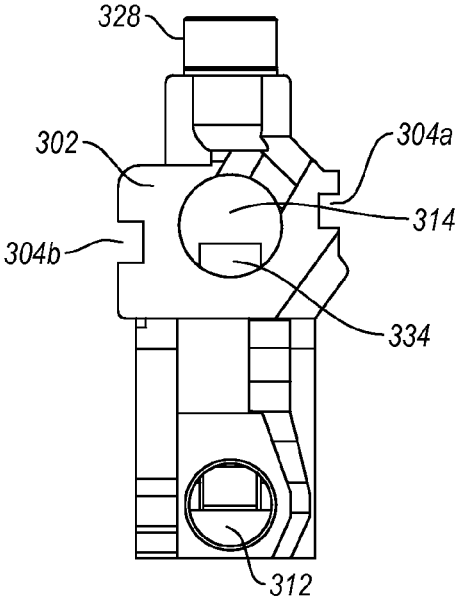
FIG. 8 depicts a front end view of the integrated slide-carrier of FIG. 3.

The integrated slide-carrier 302 includes a rear channel 334, which communicates with the slide bore 314 in a rear portion of the slide bore 314. The rear channel 334 of the integrated slide-carrier 302 includes rear channel rails 336 recessed into the sides of the rear channel 334. The rear channel rails 336 extend forward from a rear surface of the integrated slide-carrier 302 and may be symmetrical on opposing faces of the rear channel 334. As can be seen in FIG. 6-8, the firing block 306 is disposed at least partially within the rear channel 334, at least partially within the slide bore 314, and at least partially outside of the integrated slide-carrier 302. Alternatively, the firing block 306 may be disposed externally to the integrated slide-carrier 302.

As shown in FIG. 7, the firing block 306 is disposed between the substantially opposing lateral faces of the rear channel 334 and substantially fills a lateral width of the rear channel 334. The width of the firing block 306 is such that the firing block 306 cannot turn laterally and jam within the rear channel 334. The firing block 306 comprises firing block rails 338 that align with the rear channel rails 336 disposed in the lateral faces of the rear channel 334. The rear channel rails 336 and the firing block rails 338 may be identical but mirrored versions of one another, but need not be. For example, the rear channel rails 336 and the firing block rails 338 of FIG. 7 are both semi-circular in transverse cross-section, but in other embodiments may be triangular in transverse cross-section, or may be rectangular in transverse cross-section. Alternatively, the rear channel rails 336 may be semi-circular in transverse cross-section, triangular in transverse cross-section, or rectangular in transverse cross-section, and the firing block rails 338 may have a different cross-section.

In any configuration, the rear channel rails 336 and the firing block rails 338 may form a cavity in which a guide pin 340 (shown in dashed lines in FIG. 7) may be disposed. FIG. 7 depicts an integrated slide-carrier 302 and firing block 306 with two pairs of rear channel rails 336 and firing block rails 338 providing two cavities in which two guide pins 340 are disposed. The guide pins 340 retain the firing block 306 along a longitudinal path of travel and restrict the longitudinal rotation of the firing block 306 such that the firing block does not jam in the rear channel 334 or the slide bore 314 during longitudinal movement. The guide pins 340 are retained by a rail cross-pin 332 that inhibits rearward movement of the guide pins 340.

As shown in FIG. 8, the rear channel 334 intersects with the slide bore 314, but the slide bore 314 and the rear channel 334 only partially overlap due to the slide bore 314 extending only part of the length of the integrated slide-carrier 302 and not extending all the way to the rear of the integrated slide-carrier 302. The firing block 306 is, therefore inserted into the rearward portion of the slide bore 314 and then held within a predetermined range of positions by the guide pins 340.

Figure 9:
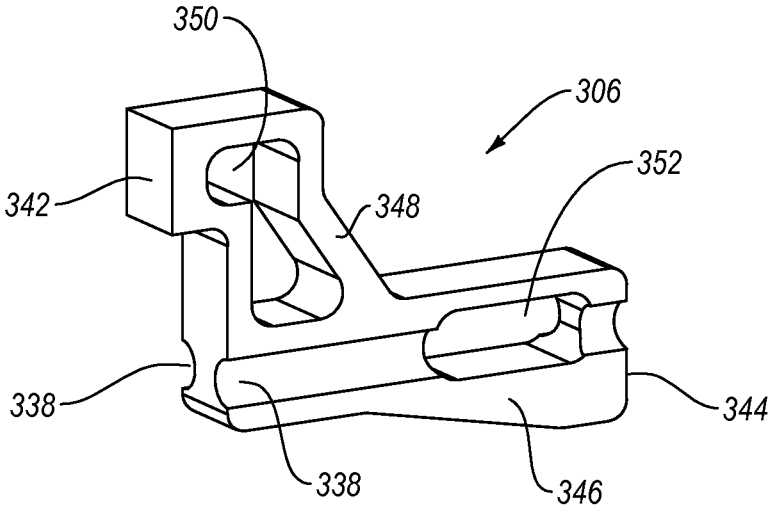
FIG. 9 depicts an isometric view of the firing block of FIG. 6.

FIG. 9 depicts the firing block 306 that is disposed at least partially within the rear channel 334, at least partially within the slide bore 314, and at least partially outside of the integrated slide-carrier 302. The firing block 306 transfers energy from a hammer 510 or other impulse source in a trigger package 508 on a first axis to a firing pin 308 on a longitudinal second axis. The first axis is also longitudinal, but need not be in alternative embodiments. Similarly, the second axis is parallel to the first axis, but need not be in alternative embodiments. The firing block 306 is generally L-shaped, but in other embodiments, the firing block may be triangular, rectangular, or any other shape capable of transferring mechanical forces from a first axis to a second, parallel axis. The firing block 306 comprises a firing pin contact surface 342 and a hammer contact surface 344. The firing pin contact surface 342 is configured to deliver an impulse to the firing pin 308 reliably, and therefore includes a flat surface to be disposed in contact with, or adjacent to a rearward end of the firing pin 308. The firing pin contact surface 342 protrudes forward into the slide bore 314 and beyond the rear channel 334. The firing pin contact surface 342 protruding beyond the rear channel 334 allows the firing pin contact surface 342 to contact the rear end of the firing pin 308 without needing the rear end of the firing pin 308 to extend past the forward end of the rear channel 334. If the firing pin 308 extends too far rearward, the firing pin 308 may catch on the forward end of the rear channel 334 and could lead to the firearm 100 jamming during operation.

The hammer contact surface 344 disposed is at the rear of the firing block 306 and extends beyond the rear end of the integrated slide-carrier 302 such that a hammer or other impulse source from the trigger package 504 may contact the hammer contact surface 344. The hammer contact surface 344 is configured to receive an impulse from the trigger package 508 reliably, and therefore includes a flat surface to be disposed in contact with, or adjacent to, a hammer 510 or other impulse source of the trigger package 508. Additionally, to withstand the receipt of and to properly transmit tens or hundreds of thousands of impulses from the trigger package 508, the firing block 306 is reinforced in some areas and lightened in other areas. For example, the firing block 306 may have additional material in a flared portion 346 leading to the hammer contact surface 344. The additional material in the flared portion 346 toughens the firing block 306 in that region and enhances the operational lifetime of the firing block 306.

Furthermore, the firing block 306 comprises a brace 348 that extends diagonally from the corner of the generally L-shaped firing block 306. The brace 348 aids in transmitting the impulse from the trigger package 508 to the firing pin 308 sufficiently efficiently to allow the removal of material elsewhere, such as a void 350, without degrading the performance of the firing block 306. By removing material and having a void 350 in the firing block 306, the overall mass and therefore inertia of firing block 306 may be reduced, resulting in a more immediate transfer of energy from the trigger package 508 to the firing pin 308. Also, a firing block 306 of greater mass and inertia may be more likely to prematurely firing the firearm 100 when the operating group 300 cycles forward. To ensure the firing block 306 remains within the desired range of movement, a pin slot 352 is included near the hammer contact surface 344 through which the rail cross-pin 332 is disposed, restricting movement of the firing block 306 and ensuring the firing block does not fall out of the integrated slide-carrier 302.

Figure 10A:
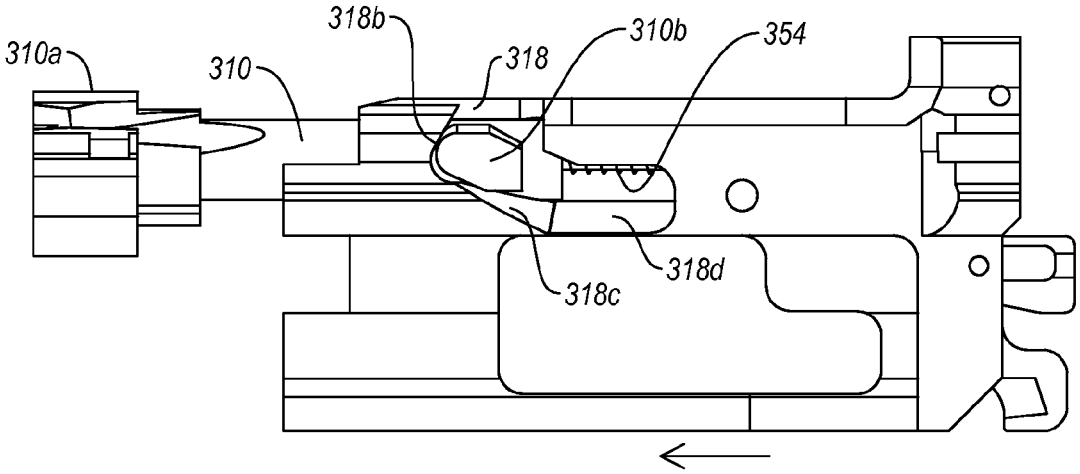
FIGS. 10A-C depict a left side view of the rotation of a bolt due to linear movement of the integrated slide-carrier of FIG. 3.
Figure 10B:
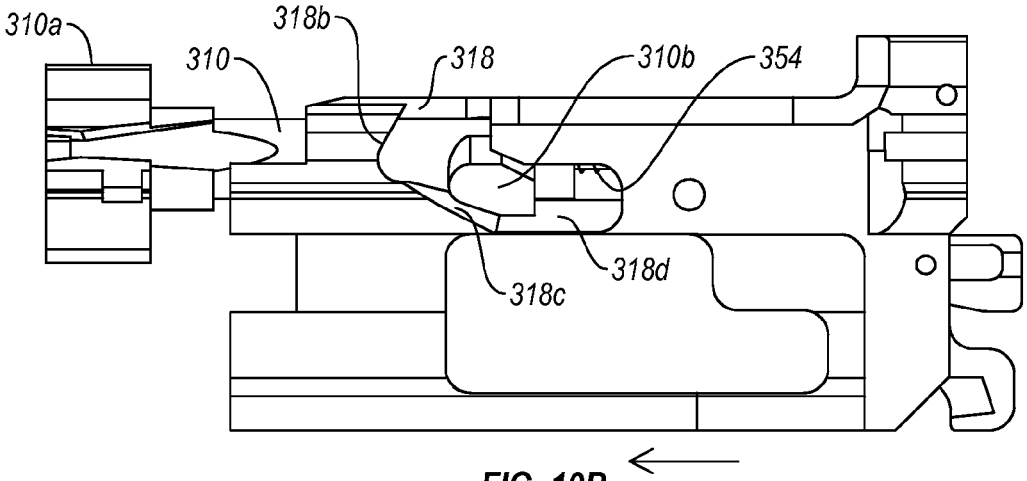
Figure 10C:
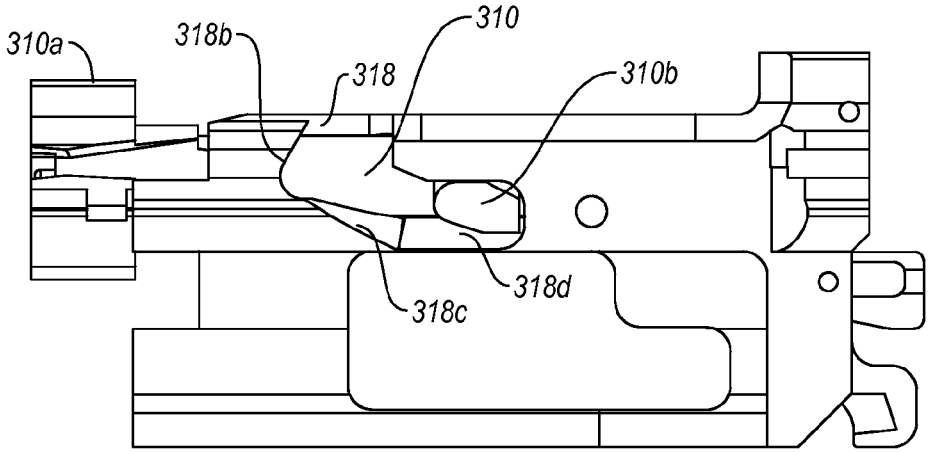

Referring now to FIG. 10A-C, the catch 318*b* retains the bolt 310 and urges the bolt 310 rearward during rearward motion of the integrated slide-carrier 302 and assists in aligning the bolt head 310*a* with the barrel extension 406 (barrel extension 406 not depicted in FIGS. 10A-C). Upon forward motion of the operating group 300 toward the barrel extension 406, the bolt 310 contacts the barrel extension 406 first and the integrated slide-carrier 302 continues moving forward, compressing a firing pin spring 354 and pushing the bolt 310 into the slide bore 314. The firing pin spring 354 is at least partially recessed into an annular recession in the bolt 310 to prevent kinking of the firing pin spring 354 during compression.

As shown in FIG. 10B, as the bolt 310 moves into the slide bore 314, the rotational portion 318*c* rotates the bolt 310 by applying torque to the bolt guide member 310*b*. The bolt guide member 310*b* slides along the rotational portion 318*c* as the slide-carrier 302 moves forward. The rotation of the bolt head 310*a* locks the bolt 310 relative to the barrel extension 406, providing a sealed chamber in which to fire a bullet. The integrated slide-carrier 302 then continues moving toward the barrel extension 406 while the bolt remains stationary and locked, as shown in FIG. 10C. The integrated slide-carrier 302 continues moving toward the barrel extension because the bolt 310 should be fully rotated and locked relative to the barrel extension 406 before the firing pin 308 (visible in FIG. 11A-C) is positioned adjacent the bullet.

Figure 11A:
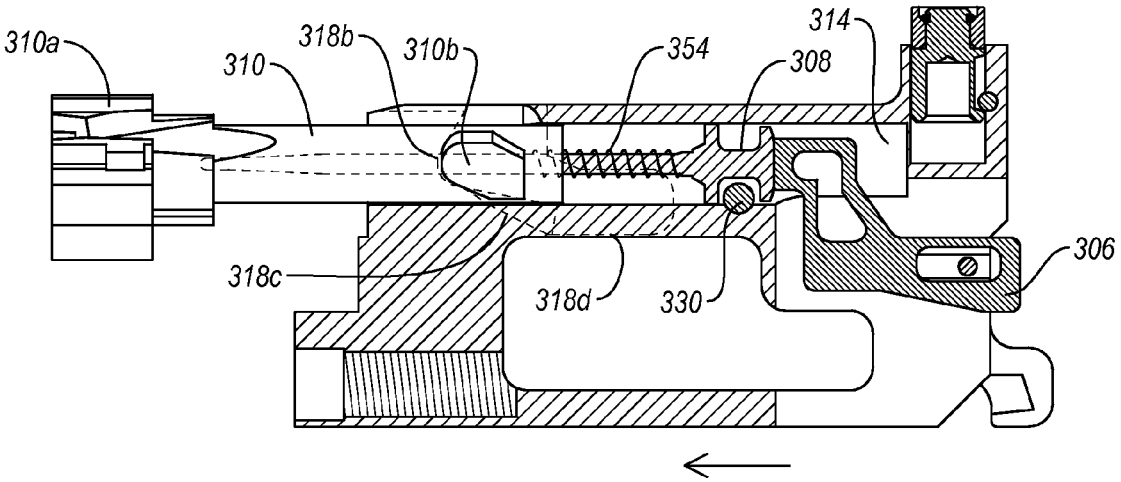
FIGS. 11A-C depict a left side cross-sectional view of the rotation of a bolt due to linear movement of the integrated slide-carrier of FIG. 3.
Figure 11B:
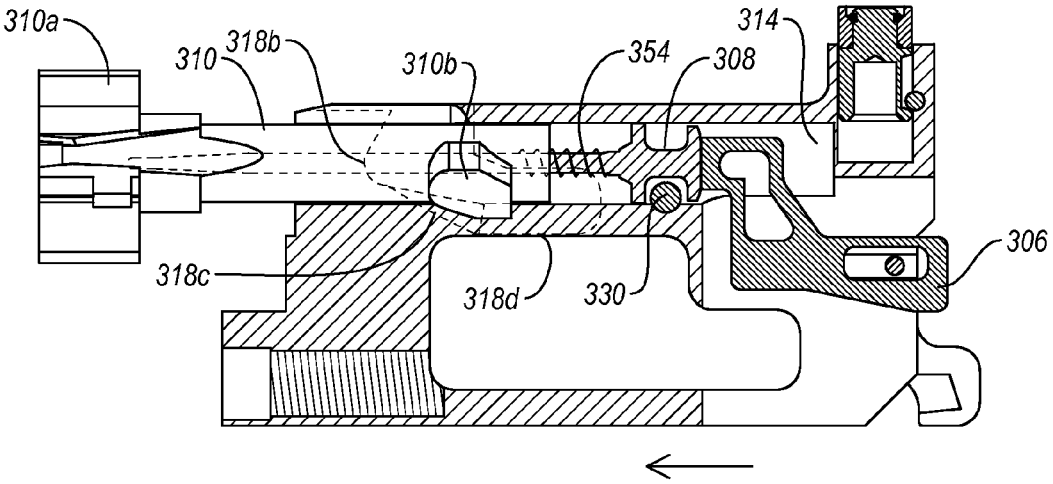
Figure 11C:
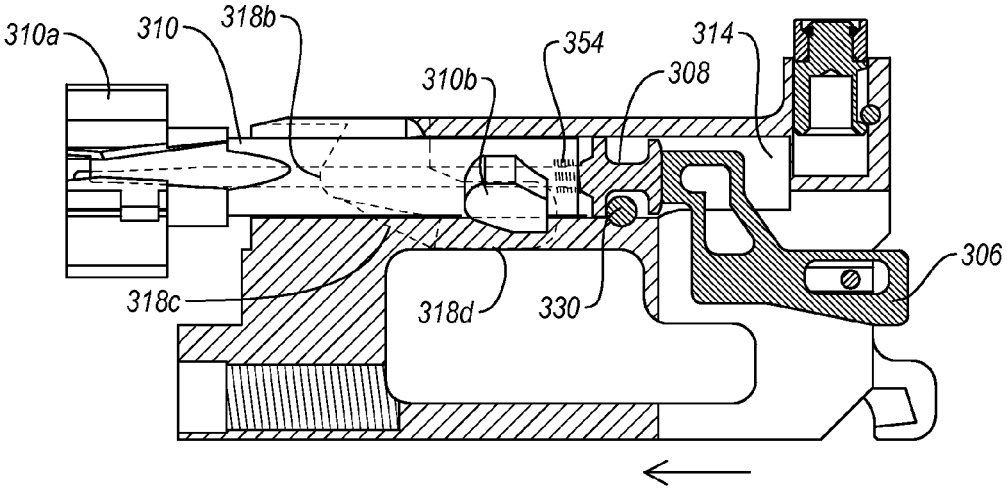

FIGS. 11A-C depict the same process in a cross-section view to show the compression of the firing pin spring 354 and the movement of the integrated slide-carrier 302 and firing pin 308 relative to the bolt 310. The catch 318*b* retains the bolt 310 and urges the bolt 310 rearward during rearward motion of the integrated slide-carrier 302 and assists in aligning the bolt head 310*a* with the barrel extension 406 (barrel extension 406 not depicted in FIGS. 11A-C). Upon forward motion of the operating group 300 toward the barrel extension 406, the bolt 310 contacts the barrel extension 406 first and the integrated slide-carrier 302 continues moving forward, compressing a firing pin spring 354 and pushing the bolt 310 into the slide bore 314.

As shown in FIG. 11B, as the bolt 310 moves into the slide bore 314, the rotational portion 318*c* rotates the bolt 310 by applying torque to the bolt guide member 310*b*. The bolt guide member 310*b* slides along the rotational portion 318*c* as the slide-carrier 302 moves forward. The rotation of the bolt head 310*a* locks the bolt 310 relative to the barrel extension 406, providing a sealed chamber in which to fire a bullet. The integrated slide-carrier 302 continues moving toward the barrel extension 406 while the bolt remains stationary and locked, as shown in FIG. 11C. The integrated slide-carrier 302 continues moving toward the barrel extension because the bolt 310 should be fully rotated and locked relative to the barrel extension 406 before the firing pin 308 is positioned adjacent the bullet.

As can be seen in FIG. 11, the firing pin spring 354 applies a force to the bolt 310 and the firing pin 308 that urges the two apart. Because the bolt 310 is locked relative to the barrel extension 406, the firing pin spring 354 urges the firing pin 308 away from the bolt 310 and rearward in the slide bore 314. However, the rearward travel of the firing pin 308 is limited by a bore cross-pin 330 and/or by the firing block 306, itself. The firing pin 108 is urged away from the bolt head 310*a* and, therefore, away from the bullet B held in the chamber. The firing pin 308 has a degree of travel around the bore cross-pin 330, however, which may be less than about 2 mm, less than about 1.5 mm, or less than about 1 mm. The force applied by the firing pin spring 354 to urge the firing pin 308 away from the bolt 310 and rearward in the bore 314 may also urge the firing block 306 rearward. As the firing block 306 moves rearward within the rear channel 334, at least part of the firing block 306 protrudes from the integrated slide-carrier 302 or otherwise be configured to receive an impulse from a trigger package 508. The protruding portion of the firing block 306 includes the hammer contact surface 344.

Figure 12A:
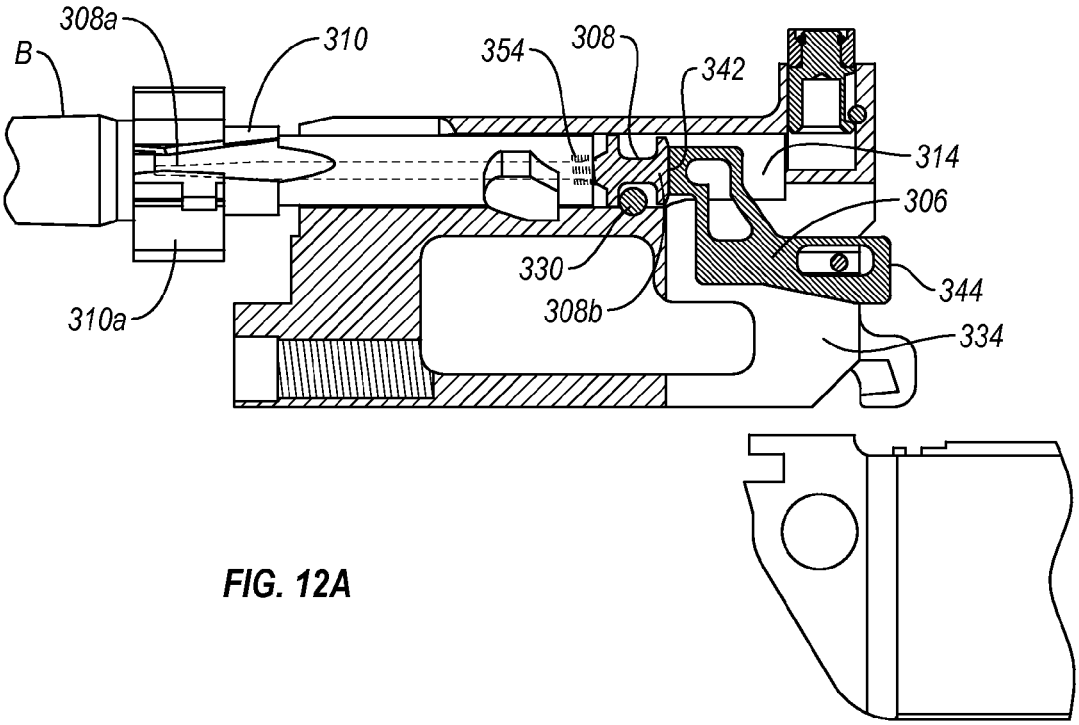
FIGS. 12A-B depict a left side cross-sectional view the detonation of a bullet by transmitting an impulse through the firing block of FIG. 6.
Figure 12B:
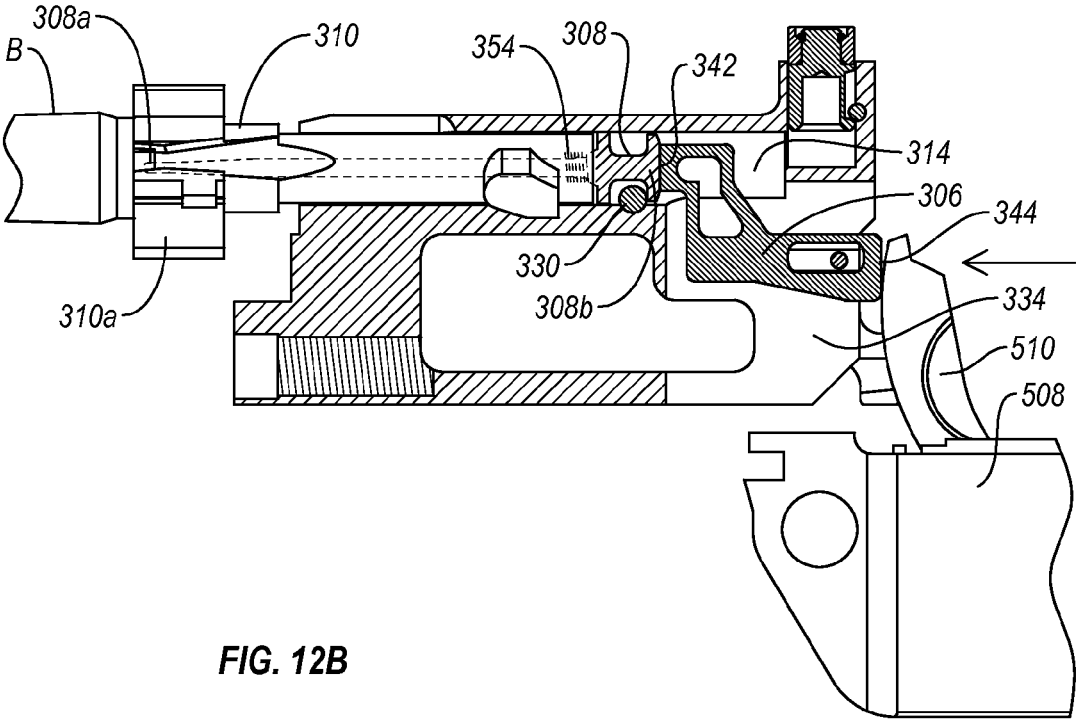

As shown in FIGS. 12A-B, once in battery, the operating group 300 is ready to transmit an impulse from the trigger package 508 to a bullet B. The hammer contact surface 344 protrudes from the rear channel 334 and the firing pin contact surface 342 may be in contact with or adjacent to the firing pin 308. The firing pin 308 rests on the bore cross-pin 330 and is held there by a force applied between the bolt 310 and the firing pin 308 by the firing pin spring 354. As depicted in FIG. 12A, when resting on the bore cross-pin 330 due to a rearward force applied by the firing pin spring 354, a tapered end of the firing pin 308*a* may be substantially flush with a surface of the bolt head 310*a* or may be recessed therefrom. The tapered end of the firing pin 308*a* may, therefore, by adjacent or proximate a bullet B.

FIG. 12B shows a movement of the firing pin 308 in response to an impulse provided by a trigger package 508. The impulse may be provided by a hammer 510 moving in a substantially arcuate fashion, as shown in FIG. 12B, a striker moving in a substantially linear fashion, or any other mechanical impulse source configured to trigger an impact or impulse explosive such as the primer in a bullet B. In an embodiment, the impulse is delivered by a curved hammer 510, such as that depicted in FIGS. 12A-B. In a further embodiment, the impulse may be delivered by a HECKLER AND KOCH hammer operated trigger package. In a yet further embodiment, the impulse may be delivered by a HECKLER AND KOCH hammer operated trigger package that is substantially unmodified. In a still yet further embodiment, the impulse may be delivered by a HECKLER AND KOCH hammer operated trigger package that is modified only to remove the ejector from the trigger package. In an embodiment, the firearm 100 is an HECKLER AND KOCH host.

The impulse is received by a hammer contact surface 344 of the firing block 306 and transmitted by the firing block 306 to a firing pin 308 through a firing pin contact surface 342 of the firing block 306. Upon receiving the impulse, the firing block 306 slides forward on the guide pins 340, moving substantially coaxially to the application of the impulse. The impulse source from the trigger package 508 may remain in contact with the firing block 306 while the firing block 306 contacts the firing pin 308, or the impulse source may strike the firing block and, after imparting energy to the firing block 306, retract from the firing block 306. In an embodiment, the impulse source from the trigger package 508 applies a force to the firing block 306 and continues applying a force to the firing block 306 even after the firing block 306 travels forward and pushes the firing pin 308 forward.

Figure 13A:
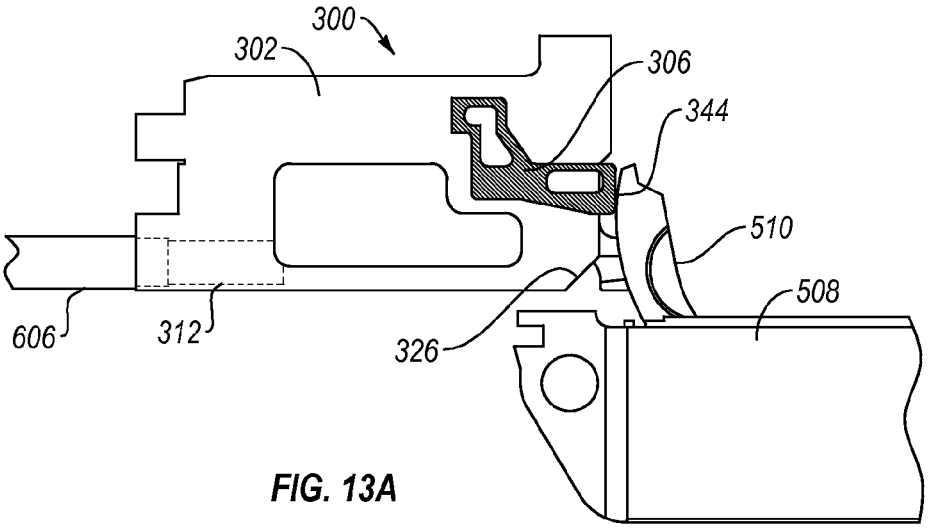
FIGS. 13A-C depict a left side cross-sectional view of resetting a hammer due to the linear movement of the integrated slide-carrier of FIG. 3.

FIG. 13A shows the operating group 300 and the trigger package 508 in the short time immediately following the combustion of the propellant in the bullet B. After the trigger package 508 has provided an impulse to the operating group 300, and, particularly, the hammer contact surface 344 of the firing block 306, to fire a bullet B, the expanding gas will impinge upon the gas piston 604 (not depicted in FIGS. 13A-C) and apply a rearward force on the operating rod 606, which is coupled to the operating rod connection 312 of the integrated slide-carrier 302. The force drives the operating group 300 rearward on the receiver rails 206*a*, 206*b* (not depicted) and the resulting rearward motion of the integrated slide-carrier applies a rearward force to the impulse source of the trigger package 508. For example, the impulse source may be a hammer 510, as depicted in FIG. 13A, but may also be a striker or other linear impulse source. When the integrated slide-carrier 302 moves rearward relative to the trigger package 508, the hammer 510 will be also urged rearward. The hammer 510 moves within a substantially arcuate path, and therefore, moving the hammer 510 rearward will cause the hammer 510 to also move toward the trigger package 508 and out of the rearward path of the operating group 300.

Figure 13B:
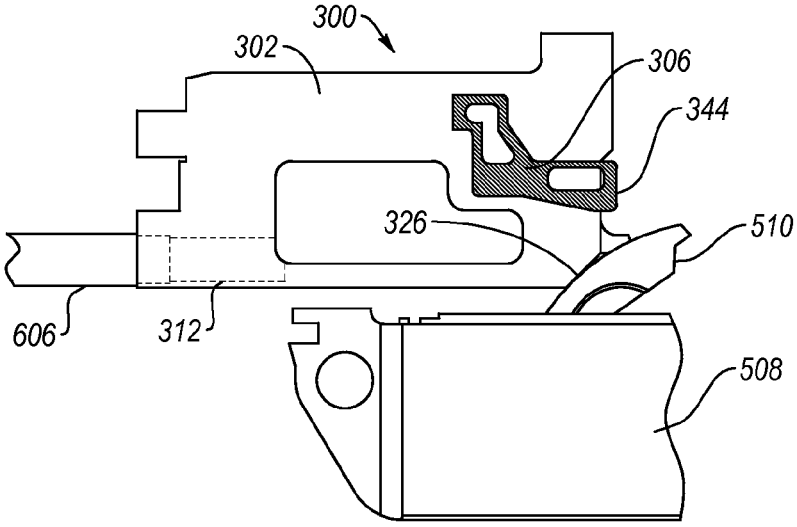
Figure 13C:
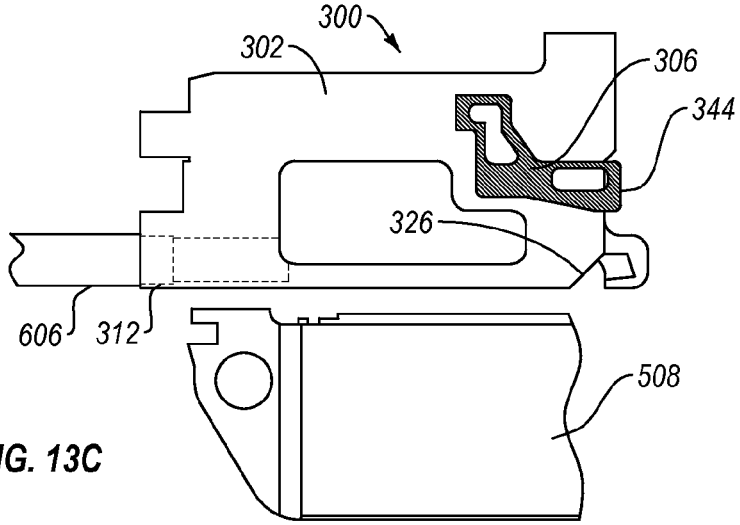

As shown in FIG. 13B, a bevel 326 disposed on a portion of the integrated slide-carrier 302 nearest the hammer 510 aids in directing the hammer 510 out of the path of the integrated slide-carrier 302 and toward the trigger package 508 and housing 502. In an alternative embodiment, the bevel 326 may alternatively be a rounded corner of the integrated slide-carrier 302 such that the rounded corner also provides a gradual and lower friction application of force to the hammer 510 or other impulse source in order to reset the hammer 510 or other impulse source, as depicted in FIG. 13C, with an increased efficiency versus an integrated slide-carrier 302 with a squared corner. The lower support 320 holds the hammer 510 or other impulse source in its reset position for substantially the entire motion of the operating group 300 during the cycling of the firearm 100 in order to give the trigger package 508 as much time as is available to safely reset the trigger and prevent additional automatic firing, be it a single round or a "runaway" firearm, or to prevent the hammer 510 merely following the operating group 300 forward and failing to impart a sufficient impulse to detonate a primer. When in fully automatic firing mode, the sear catch arm 324 engages a sear on an appropriate fully automatic trigger package 508 and allows for a delayed release of the hammer 510 or other impulse source. The delayed release of the hammer 510 or other impulse source ensures the impulse is sufficient to detonate a primer.

Figure 14A:
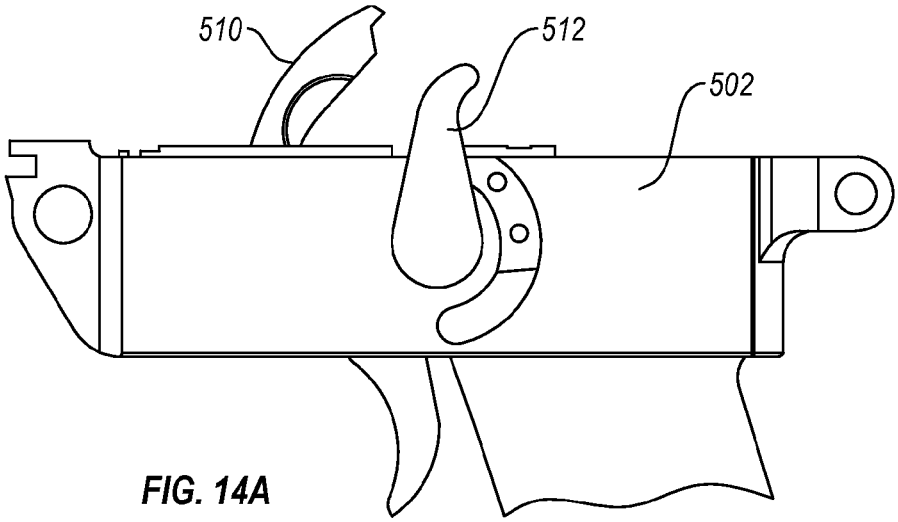
FIGS. 14A-C depict the use of a selector stop with a fire mode selector switch.
Figure 14B:
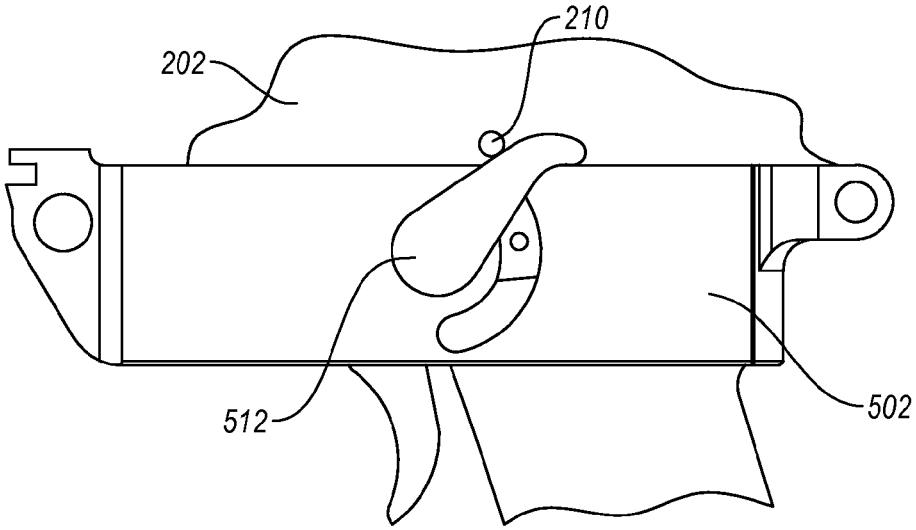
Figure 14C:
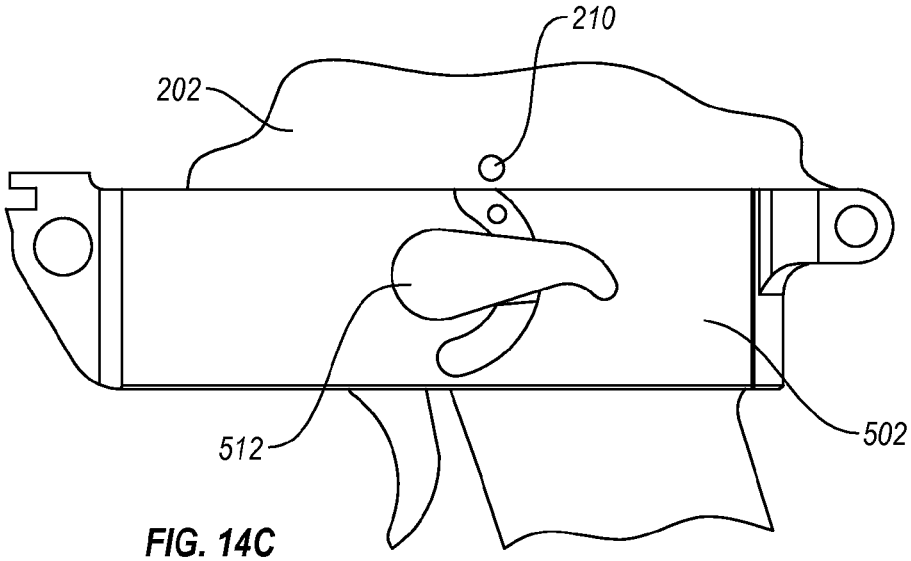

Referring now to FIGS. 14A-C, the fire mode selector switch 512 is mounted on the housing 502 and trigger package 508, and selects the fire mode for the trigger package 508. While a three-position fire mode selector switch 512 is depicted in FIGS. 14A-C, a number of trigger packages 508 are commercially available, including variants that may include more than three positions. As shown in FIG. 13A, a counterclockwise-most position of the three-position fire mode selector switch 512 is a "disassemble" position. When the fire mode selector switch 512 is in the counterclockwise-most position, it may be removed from the housing 502 and from the trigger package 508. The fire mode selector switch 512 is the only connection that retains the trigger package 508 in the housing 502. Therefore, when the fire mode selector switch 512 is removed from the housing 502 and trigger package 508, there are no further connections holding the trigger package 508 in place, and the trigger package 508 is free to move within the housing 502 and within the receiver body 202.

As can be seen in FIG. 14B, to prevent accidental removal of the fire mode selector switch 512 when the firearm 100 is assembled, a selector stop 210 is disposed on the receiver body 202 such that the "disassemble" position may not be achieved when the control assembly 500 is attached to the receiver 200. The fire mode selector switch 512 is depicted in a second position in FIG. 14B. The second position is substantially rotationally adjacent the selector stop 210. In an embodiment, the second position may be a "safe" mode, in which the trigger package 508 is inhibited from releasing the hammer 510 or other impulse source and the firearm 100 is therefore unable to fire. In another embodiment, the second position may be a firing mode, and the firing mode may include a semi-automatic, burst-fire, or fully-automatic firing mode.

FIG. 14C depicts a third position of the fire mode selector switch 512, which is rotationally further from the selector stop 210 than the second position. In an embodiment, the third position may be a "safe" mode, in which the trigger package 508 is inhibited from releasing the hammer 510 or other impulse source and the firearm 100 is therefore unable to fire. In another embodiment, the third position may be a firing mode, and the firing mode may include a semi-automatic, burst-fire, or fully-automatic firing mode.

Figure 15:
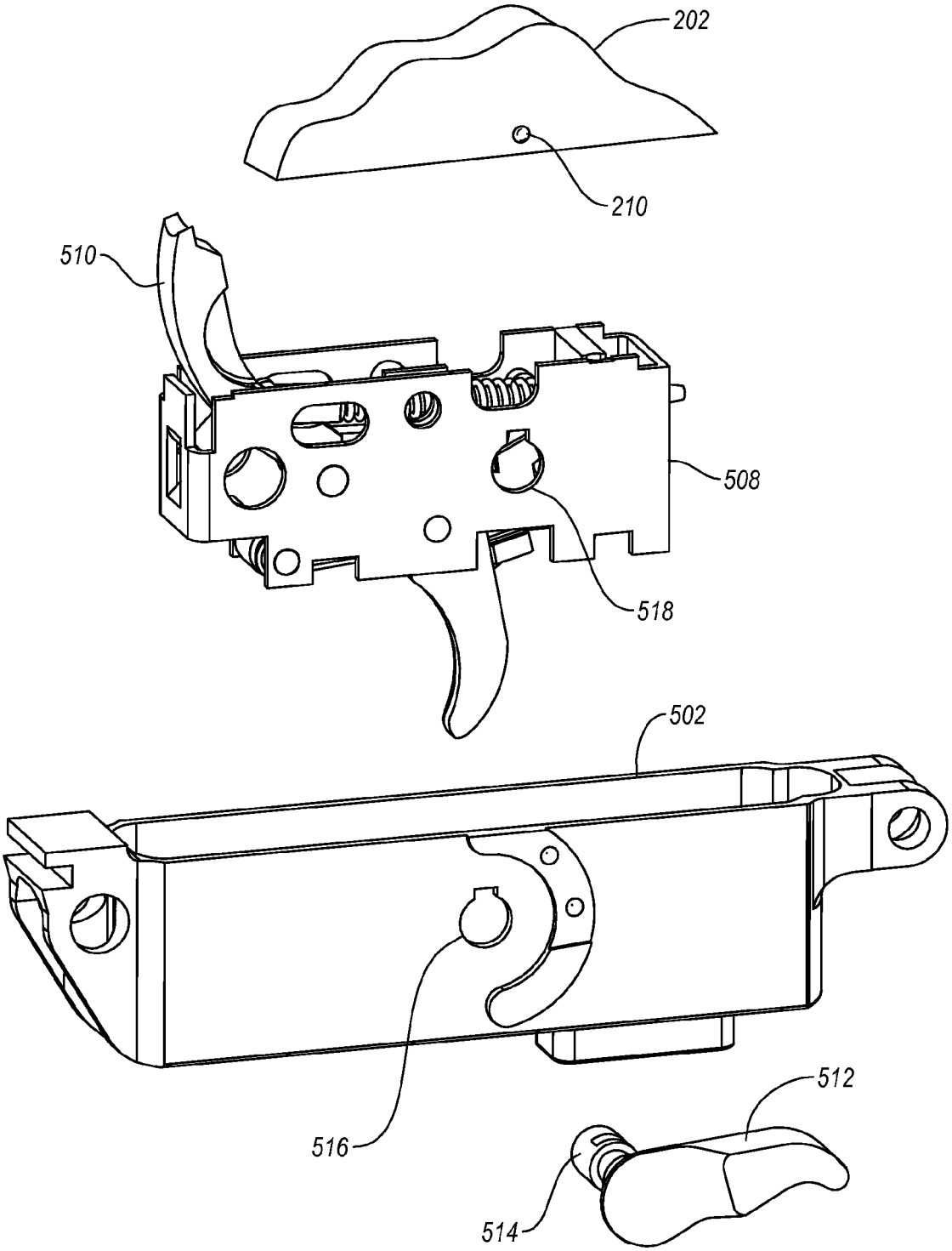
FIG. 15 depicts an exploded view of the removable trigger package and selector switch.

FIG. 15 depicts an exploded view of the removable trigger package 508 from the grip housing 502. Fire mode selector switch shaft 514 extends the width of the housing 502. When the trigger package 508 is disposed within the housing 502, housing port 516 aligns with trigger package port 518, and fire mode selector switch shaft 514 may be inserted through the width of the housing 502 and the trigger package 508 to secure the trigger package 508 within the housing 502.

When the fire mode selector switch 512 rotates to the "disassemble" position depicted in FIG. 14A, the fire mode selector switch 512 may be removed. There is no other connection between the trigger package 508 and the grip housing 502 securing the trigger package 508 in the grip housing 502. Therefore, upon removal of the fire mode selector switch 512 (by lateral movement of the fire mode selector switch 512) from the grip housing 502 and the trigger package 508, the trigger package 508 is no longer secured to any part of firearm 100.

The terms "approximately," "about," and "substantially" as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of a stated amount.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An apparatus for use in discharging ammunition in a firearm, the apparatus comprising:

an integrated slide-carrier having a slide bore extending therein and open at a first end;

a hammer configured to provide a force along a first axis; and a firing block configured to translate the force from the first axis to a second axis, the first and second axis not being coaxial, wherein the firing block is disposed at least partially within the integrated slide-carrier.

2. The apparatus of claim 1, wherein the first and second axes are both longitudinal axes.

3. The apparatus of claim 1, wherein the first and second axis are parallel.

4. The apparatus of claim 1, further comprising guide pins, the guide pins oriented longitudinally and configured to restrict the movement of the firing block.

5. The apparatus of claim 4, wherein the firing block further comprises firing block rails configured to receive the guide pins.

6. The apparatus of claim 1, further comprising a bolt disposed at least partially within the slide bore.

7. The apparatus of claim 6, further comprising a firing pin disposed at least partially within the bolt and adjacent to at least part of the firing block.

8. An apparatus for use in discharging ammunition in a firearm, the apparatus comprising:

an integrated slide-carrier having an elongate upper portion with a slide bore therein and an elongate lower support member connected by at least one connection member;

a firing pin disposed at least partially within the bore;

an impulse source configured to provide an impulse in a first axis and a firing block disposed at least partially within the integrated slide-carrier, a forward portion of the firing block disposed substantially adjacent to the firing pin and a rear portion of the firing block disposed at least partially outside the integrated slide-carrier wherein the rear portion of the firing block is configured to receive an impulse from the impulse source on the first axis and transmit the impulse to the firing Din on a second axis.

9. The apparatus of claim 8, further comprising a bolt disposed at least partially within the slide bore and configured to receive at least part of the firing pin therethrough.

10. The apparatus of claim 8, wherein the impulse source is a striker.

11. The apparatus of claim 8, wherein the impulse source is a hammer.

12. The apparatus of claim 11, wherein the hammer extends a height less than a height of the integrated slide-carrier.

13. The apparatus of claim 8, wherein the firing pin extends at least partially out a front end of the bore.

14. An apparatus for use in discharging ammunition in a firearm, the apparatus comprising:

a body having an elongate upper portion with a bore therein and an elongate lower portion connected to the elongate upper portion by at least one connection member;

a firing pin disposed at least partially within the bore and extending at least partially out a front end of the bore;

a hammer configured to provide a longitudinal force along a first longitudinal axis; and a firing block disposed at least partially within the body, a forward portion of the firing block disposed substantially adjacent to the firing pin and a rear portion of the firing block disposed at least partially outside the body and substantially adjacent to the hammer, wherein the firing block is configured to translate the longitudinal force from the first longitudinal axis to a second longitudinal axis, the first and second longitudinal axes being parallel to and offset from one another.

15. A method for discharging ammunition in a firearm, the method comprising:

providing the apparatus of claim 1;

striking the firing block with a hammer;

translating a force from the hammer applied to the firing block from a first longitudinal axis to a second longitudinal axis, wherein the first and second longitudinal axes are parallel; and transmitting a force from the firing block to a firing pin.

16. A system for discharging ammunition in a firearm, the system comprising:

an elongate receiver defining an interior volume, the elongate receiver having a left rail and a right rail disposed within the interior volume;

an integrated slide-carrier having a slide bore extending therein and open at a first end;

a firing block configured to transmit an impulse from a first axis to a second axis, the first and second axes being non-coaxial; and a left elongated recession and a right elongated recession in the integrated slide-carrier, the left and right elongated recessions configured to align with and slide longitudinally along the left and right rails;

a firing pin disposed at least partially within the bore and extending at least partially out a front end of the bore, the firing pin being disposed adjacent a first end of the firing block; and an impulse source configured to strike a second end of the firing block, the impulse source having a rotatable fire mode selector switch removable from a housing when rotated to a disassemble position; and a selector stop disposed on an outer surface of the elongate receiver, the selector stop configured to prevent the fire mode selector switch from reaching a disassemble position.

17. The system of claim 16, wherein the firing block is at least partially disposed within the integrated slide-carrier.

18. The system of claim 17, wherein the first end of the firing block is disposed at least partially associated with a second end of the slide bore and the second end of the firing block is disposed at least partially outside the integrated slide-carrier.

19. An apparatus for use in discharging ammunition in a firearm, the apparatus comprising:

an integrated slide-carrier having a slide bore extending therein and open at a first end;

a firing block configured to translate a force from a first axis to a second axis, the first and second axes not being coaxial, the firing block including firing block rails;

guide pins positioned at least partially in the firing block rails, the guide pins oriented longitudinally and configured to restrict the movement of the firing block.

* * * * *